US005561270A

United States Patent [19]

Baessler et al.

[11] Patent Number: 5,561,270

[45] Date of Patent: Oct. 1, 1996

[54] CONNECTION CARRIER AND METHOD FOR PRODUCING CONNECTION CARRIERS

[75] Inventors: Gerd Baessler, Pforzheim; Peter Asslaender, Bamberg, both of Germany

[73] Assignee: Robert Bosch GmbH, Stuttgart, Germany

[21] Appl. No.: 308,171

[22] Filed: Sep. 19, 1994

[30] Foreign Application Priority Data

Sep. 22, 1993 [DE] Germany ..... 43 32 172.0

[51] Int. Cl.[6] ..... H01R 4/26

[52] U.S. Cl. ..... 174/94 R; 439/878; 29/863

[58] Field of Search ..... 174/94 R, 84 R; 29/861, 863, 874, 882; 439/877, 878, 881, 884, 891; 72/379.2

[56] References Cited

U.S. PATENT DOCUMENTS

| | | | |
|---|---|---|---|
| 538,488 | 3/1895 | Suter . | |
| 2,802,194 | 8/1957 | Kirk . | |
| 3,110,329 | 11/1963 | Lhomme et al. . | |
| 3,617,616 | 11/1971 | O'Loughlin | 174/94 R |
| 3,910,666 | 1/1975 | McIntosh | 174/94 R |
| 3,918,790 | 11/1975 | Filson | 24/257 R |
| 3,945,709 | 3/1976 | Filson | 29/630 A |
| 4,143,936 | 3/1979 | DeRoss et al. | 439/881 |
| 4,248,075 | 2/1981 | Whitley | 72/335 |
| 4,719,440 | 1/1988 | Nakamura et al. | 174/94 R |
| 4,870,747 | 10/1989 | Maack et al. | 29/753 |
| 5,407,371 | 4/1995 | Chen | 439/886 |

FOREIGN PATENT DOCUMENTS

| | | |
|---|---|---|
| 3404008 | 8/1985 | Germany . |
| 3615809 | 11/1987 | Germany . |

*Primary Examiner*—Kristine L. Kincaid
*Assistant Examiner*—Marc Machtinger
*Attorney, Agent, or Firm*—Kenyon & Kenyon

[57] ABSTRACT

In a method for the production of connection carriers, a V-shaped recess (3) is formed in the connection carrier (1) by punching, then a very precise slit (18) is produced in the immediate vicinity of the recess end region (10) by stamping or caulking the carrier cheeks (13) and ( 14) of the connection carrier (1). At least two windings (26) and (27) of a wire (5) are then inserted into the slit (18), whereby the windings cannot slip onto each other because of the dimensions of the slit (18) which resulted from stamping. Finally, hot-forming of the connection carrier (1) occurs, so that the windings (26) and (27) are completely surrounded in the slit (18) and an electrically conductive connection between the connection carrier (1) and the wire (5) is produced.

13 Claims, 2 Drawing Sheets

CONNECTION CARRIER AND METHOD FOR PRODUCING CONNECTION CARRIERS

FIELD OF THE INVENTION

The present invention relates to a connection carrier and to a method for the production of connection carriers and for the attachment of metal wires to connection carriers.

BACKGROUND OF THE INVENTION

Metallic connection carriers to which metal wires can be attached are described in German Application No. DE-OS34 04 008. The connection carriers each have a slit forming a recess into which the end of the wire is placed. The shape of the slit can be determined both by edges that run parallel to each other and by edges which run at an angle to each other. The slits, which are formed by punching, can have a smooth, a riffled or a corrugated surface contour. The wire end is passed once through the slit provided in the connection carrier. Subsequent forming of the connection carrier to clamp the wire end in place occurs, with the forming taking place in the heated state at a temperature below the melting temperature of the carrier material. In this way, a mechanically strong and electrically conductive connection between the wire and the connection carrier is formed in a simple manner. The wire end is squeezed at the clamping location and takes on an oblong, elliptical cross-section.

Furthermore, it is known from German Application No. DE-OS 36 15 809 that the quality of such a connection, produced by means of a so-called hot-staking method, can be further improved, particularly for very thin wires, if the wire end is passed through the recess several times. In this way, the forces which occur during the attachment process are distributed over several wires, so that each individual wire is subject to less deformation. The recess is slit-shaped and has a widened part to hold the wire end at the end opposite the open end, with the entire recess being formed by punching.

Efficient use of punching is dependent on the material, its strength, the material thickness and the desired slit width. In the case of recesses with an opening width of approximately 0.3 mm, a limit range of economically efficient punching is reached, since in the case of smaller recesses the punches break off after only a few punching processes due to the low sheet metal thickness. Thus, very high tool down times occur or punching is not even possible.

SUMMARY OF THE INVENTION

The connection carrier according to the present invention has the advantage that it has a region in the recess for the placement of ultrathin wires into which wires even with a diameter of less than 0.3 mm can be easily and cost-effectively inserted in automated series production at high speed and with great process reliability, and then welded in place.

The method for the production of metallic connection carriers for the attachment of metal wires according to the present invention has the advantage that series production can be carried out cost-effectively, at high speed and with great process reliability, even if ultrathin wires are to be placed into the connection carrier.

DETAILED DESCRIPTION

Figure 1:
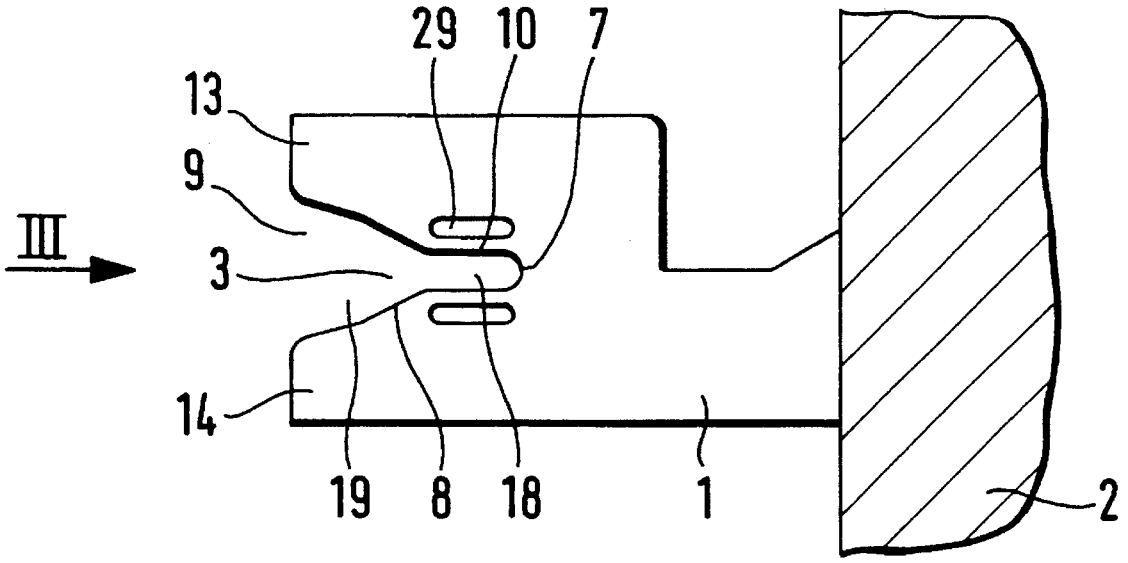
FIG. 1 shows a connection carrier produced by the method of stamping according to the present invention.
Figure 2:
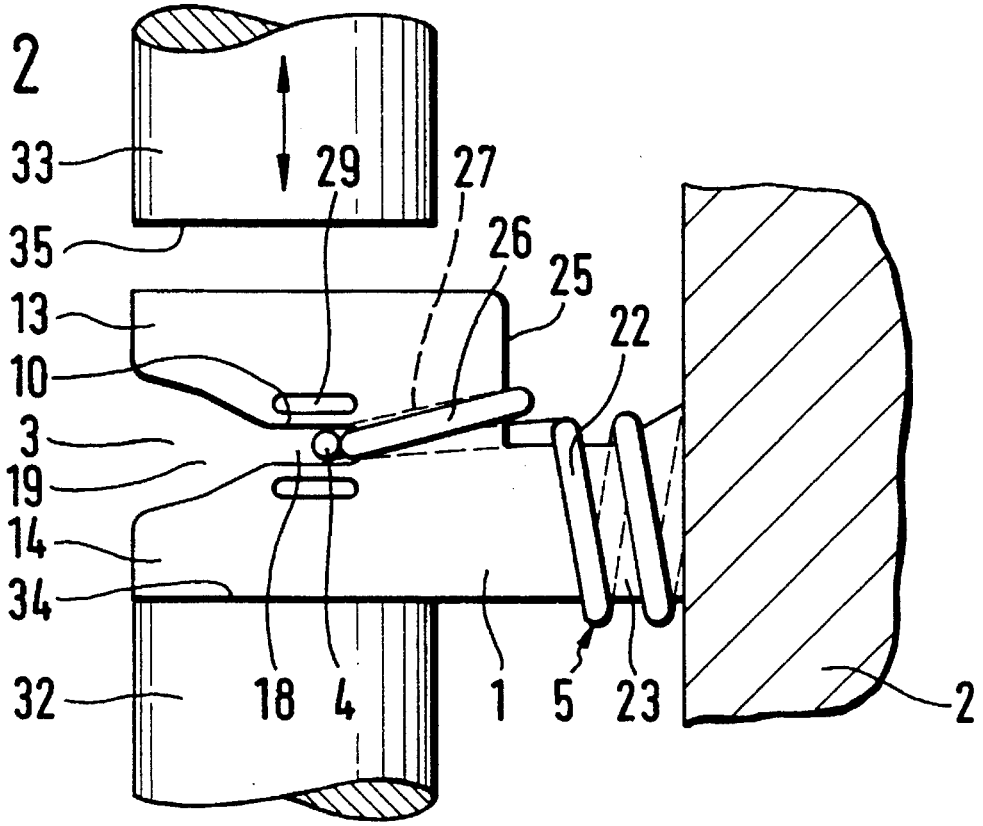
FIG. 2 Shows a connection carrier according to the present invention having a metal wire placed into it, as well as a tool for hot-forming the connection carrier.
Figure 3:
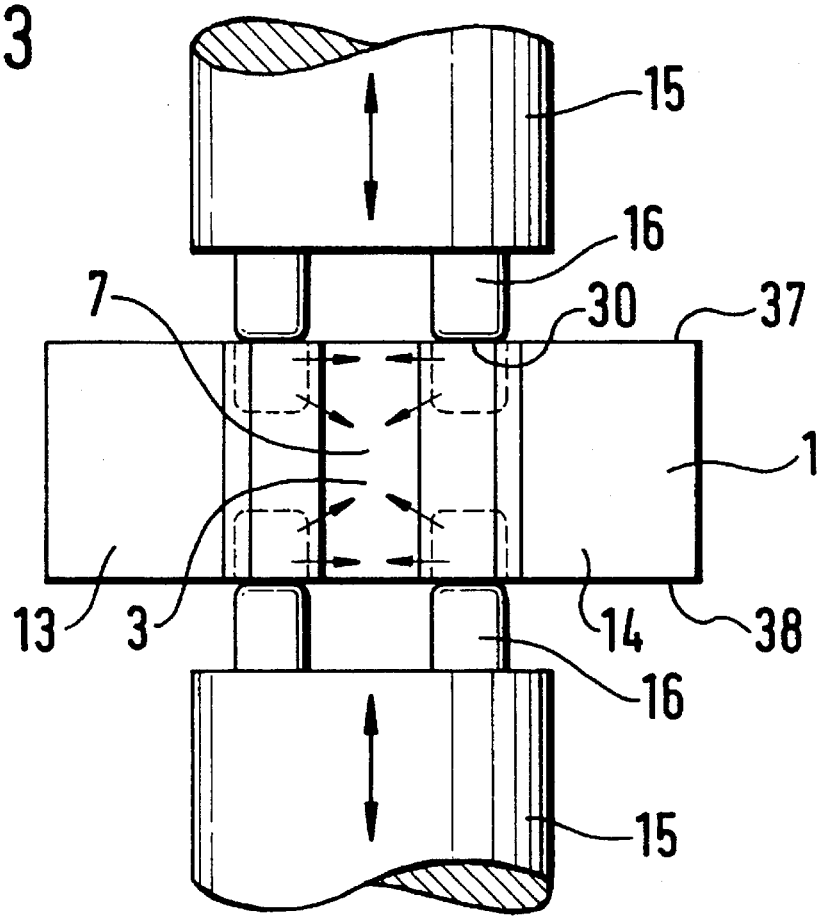
FIG. 3 shows a connection carrier according to the present invention with a stamping tool.

In FIGS. 1 to 3, a connection carrier 1 is partially shown as a preferred embodiment according to the present invention; it serves to attach metal wires, for example, wires of a current coil. The connection carrier 1 includes a flat metal tongue or metal flag, which is attached in a holder 2, for example a coil carrier, at its one end. At its free end, opposite the attached end, the connection carrier 1 has a recess 3, into which an end 4 of a wire 5 of the coil winding can be inserted. The recess 3 is open towards the free end of the connection carrier 1, in order to facilitate insertion of the wire end 4.

The recess 3 is formed in the flat metal flag of the connection carrier 1 at its free end by punching. Using punches with a corresponding shape, a V-shape of the recess 3 is achieved. The V-shaped recess 3 has a recess base 7 which faces the holder 2, which has a radius, for example, and from which a constantly widened part 8 of the recess 3, which does not, however, have to progress at a constant angle, is formed up to a recess opening 9.

In order to guarantee the greatest possible process reliability for automatic insertion of the wire 5 into the recess 3, it is therefore practical if the dimension of the recess opening 9 at the direct free end of the connection carrier 1 amounts to a multiple of the diameter of the wire 5. The production of the V-shaped recess 3 with different angles in the progression of the widened part 8 is known in the punching technology art.

In known connection carriers, recesses for the insertion of wires are also formed by punching. However, it has been shown that a limit range has been reached with an opening width of approximately 0.3 mm of the recesses, which are slit-shaped, for example, and that efficient punching of connection carriers which have a sheet metal thickness of less than 1 mm is not possible. In series production of the connection carriers, significant tool down times would result for punching of openings below 0.3 mm, since the punches would break off after only a few punching processes because of the disadvantageous ratio of sheet metal thickness to opening width. Accordingly, the punches would have to be replaced as often as they break. The method according to the present invention is particularly useful for ultrathin wires 5 with diameters below 0.3 mm, with which method high process reliability is guaranteed for high-speed, cost-efficient production in spite of these extreme dimension conditions.

Referring to FIG. 2, a recess end region 10 according to the present invention, which directly follows the recess base 7 and is V-shaped at first, is changed in its shape by stamping, i.e. caulking. For this purpose, forces are applied, most practically on both sides, to the carrier cheeks 13 and 14 of the connection carrier 1 separated by the recess 3, perpendicular to the plane of the drawing of FIGS. 1 and 2, which slightly displaces the material of the connection carrier 1.

FIG. 3 shows a schematic, simplified representation, not to scale, as to how the stamping tool 15 acts on the surface of the connection carrier 1 with its stamping punches 16, indicated by the broken lines of the stamping punches 16. As a result of the stamping, i.e. calking of the connection carrier 1 in the region of the two carrier cheeks 13 and 14, the V shape of the recess 3 is lost, at least partially, in the recess end region 10. In this way, a contour of the recess 3 can be achieved, in which the walls of the carrier cheeks 13 and 14 run parallel to each other in the connection end region 10. The originally entirely V-shaped recess 3 in the connection carrier 1 is divided into two regions after stamping: a region 18 referred to as a slit, which was formed by the material displacement of stamping; and a funnel-shaped opening region 19 which was not influenced by stamping. The slit 18 as a part of the recess 3 ends with the recess base 7, as the recess 3 did before stamping, and makes a smooth transition into the opening region 19 towards the free end of the connection carrier 1.

After stamping, the opening width of the slit 18 is only slightly larger than the diameter of the wire 5. The wire 5 is formed into a spiral 22 with several windings, which are wound onto the connection carrier 1. A part 23 of the connection carrier 1, wrapped by the spiral 22 of the wire 5, directed towards the holder 2, has a lesser width than that part in which the recess 3 is formed. The transition at the upper edge towards the carrier cheek 13 of the connection carrier 1 is formed as a right-angle shoulder 25, for example, against which the last winding of the spiral 22 can rest.

Proceeding from the last winding of the spiral 22, which rests against the shoulder 25 or is arranged close to the shoulder 25, a region of the wire end 4 is drawn through the slit 18 twice, for example, in such a way that a first closed winding 26 and a second open winding 27, with the progression evident in FIG. 2, are formed. The two windings 26 and 27 wrap around the connection carrier 1 in the region between its shoulder 25 and the slit 18 and lie next to each other in spiral form. While the winding 26 of the wire 5 which lies directly against the recess base 7 is supposed to take on the actual contact function, the winding 27 of the wire 5, which lies next to winding 26 in the direction towards the recess opening 9, serves to distribute the forces which occur during the attachment process. In addition, the winding 27 possesses a support function. The windings 26 and 27 therefore already lie next to each other in the direction of progression of the slit 18 even before the attachment process.

This is advantageous in that it is important for so-called hot staking welding of the wires in the connection carrier 1 that the two windings 26 and 27 of the wire 5 lie next to each other in the slit 18 of the recess 3. In other words, the requirement for the recess 3 is that at least in the recess end region 10, which represents the slit 18 after stamping, and in which the windings 26 and 27 are partially held, the opening width available is so slight that the two windings 26 and 27 cannot slip onto each other. The opening widths of the slits 18 to be achieved by means of stamping therefore result from the diameters of the wires 5. At a wire diameter of 0.15 mm, for example, the opening width of the slit 18 should be a maximum of 0.25 mm. As already described, these very narrow slits 18 cannot be efficiently produced by punching.

Slits 18 which can be as narrow as desired, as determined by the wire diameters, can be produced by stamping. In spite of the very simple and cost-effective stamping method, very close tolerances can be maintained, for example between 0.01 mm and 0.05 mm, which are dependent on the quality and the shape of the stamping tool 15 with its stamping punches 16, and on the parameters of the stamping process. Stamping takes place close to the walls of the carrier cheeks 13 and 14 at the recess end region 10. Depending on the desired width of the slit 18, the stamping punches 16 can act closer to or more removed from the recess 3. However, the stamping punches 16 will always act closer to the recess 3 than to the outside contour of the carrier cheeks 13 and 14. The distance between the stamping punches 16 and the beginning of the recess end region 10 is the main factor determining the amount of material displacement perpendicular to the expanse of the recess 3.

Another important parameter is the stamping force with which the stamping punches 16 act on the connection carrier 1, most practically on both sides, as shown in FIG. 3. Namely, stamping may be done in such a way that stamping occurs both to the right and the left of the recess 3, and from above and below the two carrier cheeks 13 and 14, so that stamping marks 29 are formed both in an upper surface 37 and in a lower surface 38 of the connection carrier 1. In doing so, the stamping punches penetrate into the material at 25% from both sides, for example, and displace material of the connection carrier 1 essentially perpendicular to the movement direction of the stamping punches. 16, over approximately half the sheet metal thickness, towards the inside, up to the desired width of the slit 18 which results.

Material is also displaced in the other directions, but this has no influence on the geometry of the slit 18. The material which is displaced only over approximately half of the sheet metal thickness of the connection carrier 1 suffices to allow proper guidance of the wire end 4. The center region of the sheet metal thickness between the stamping punches, which is not displaced by stamping, is finally formed during welding in such a way that the two windings 26 and 27 of the wire 5 are completely surrounded in the region of the slit 18.

The stamping punches 16 can be applied to the connection carrier 1 parallel to the subsequent slit 18, for example, as the remaining stamping marks 29 in FIGS. 2 and 3 show, but also at a slant, in other words parallel to the original V-shaped contour of the recess 3, for example. From these variations in the point of attack of the stamping punches 16, numerous different shapes of the slit 18 can be obtained, with the walls of the carrier cheeks 13 and 14 at the recess end region 10 not necessarily running parallel to one another. The deciding factor is that the opening width of the slit 18 does not take on twice the diameter of the wire 5.

The size and the shape of the stamping punches 16 are also important for the slit geometry. The length of the stamping punches 16 in the direction of expanse of the recess 3 from the recess base 7 to the recess opening 9 is responsible for the length ratio between the slit 18 and the opening region not influenced by stamping, relative to one another.

Figures 4, 5, 6, 7:
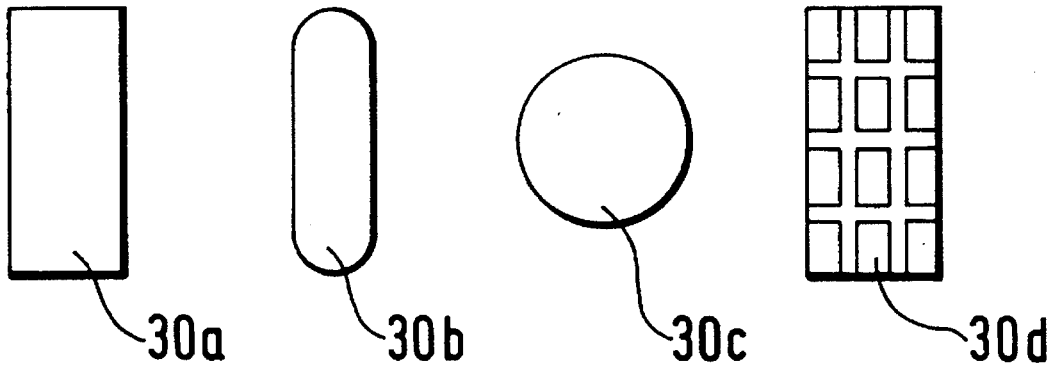
FIGS. 4, 5, 6 and 7 each show one of four different punch faces for stamping punches of stamping tools that can be used to form a connection carrier according to the present invention.

Some forms of punch faces 30, with which the first contact against the connection carrier 1 occurs during stamping, and which also have a decisive influence on the shape of the slit 18, are shown in FIGS. 4 to 7. FIG. 4 shows a rectangular punch face **30*a* of the stamping punch 16. FIG. 5 shows an elliptical or partially elliptical punch face 30*b*. FIG. 6 shows a circular punch face 30*c*. FIG. 7 shows a so-called waffle-shaped punch face 30*d***. Aside from using the punch shapes mentioned, or other ones, individually, it is also possible to perform stamping more than once, for example using different punch shapes or combinations of shapes.

In order to produce an electrically conductive, strong connection between the connection carrier 1 and the wire 5, the windings 26 and 27 of the wire end 4 are wedged in place in the slit 18. This is done in that a force acts on the carrier cheeks 13 and 14 of the connection carrier 1, which force is sized and directed in such a way that narrowing of the slit 18 takes place, with the walls of the carrier cheeks 13 and 14 being brought closer together or into contact with one another at the slit 18. It is essential in this connection that this forming of the connection carrier 1 does not take place in the cold state, but rather in the heated state, at temperatures which lie below the melting temperature of the carrier material.

Soft-forming of the connection carrier 1 preferably takes place by means of resistance heating, using a fixed electrode 32 and a movable electrode 33. The fixed electrode 32 has a flat upper face 34, for example, on which the carrier cheek 14 of the connection carrier 1 is placed. The upper movable electrode 33 can be moved perpendicular to the expanse of the recess 3. Its lower face 35 can act on the carrier cheek 13 of the connection carrier 1 with a force that can be preselected. In addition to the flat tungsten electrodes, slanted electrodes can also be used.

As soon as the electrode 33 rests on the carrier cheek 13 with its face 35, current is released into the electrodes 32 and 33, with the current intensity and the time being selected in such a way that the metal of the connection carrier 1, particularly in the region of the carrier cheeks 13 and 14, undergoes softening by means of resistance heating.. If the degree of softening of the material exceeds a certain point, then the carrier cheeks 13 and 14 give way to the pressure of the electrodes 32 and 33 and place themselves against each other, with the slit 18 closing. In this process, the windings 26 and 27 are wedged in place. The current intensity and also the time of current application must be adapted to the diameter of the wire 5.

After hot-forming is complete, the slit 18 has assumed the shape of a stretched ellipsis, for example. The two windings 26 and 27, which lie next to one another, have egg-shaped cross-sections in the region of the clamping site, with the radius of the surfaces that touch each other approximately corresponding to the original radius of the wire 5. The windings 26 and 27 of the wire 5 keep their original cross-section size, to a great extent, because they oppose compression and deformation during the attachment process with greater resistance than a single wire would be able to do. Resistance heating has the advantage that the amount of heat applied to the connection carrier 1 can be very precisely metered.

What is claimed is:

1. A connection carrier, comprising:

a conductive member having a first end and a second end, the second end having a recess opening for receiving a wire end inserted into the conductive member, the recess opening having a recess base and a recess end region;

wherein a stamping mark formed on the conductive member adjacent to the recess opening forms a slit opening extending from the recess base, the slit opening providing a predetermined reduction of an opening width of the recess end region, the recess opening having a V-shaped opening adjacent to the slit opening and extending to the second end.

2. The connection carrier according to claim 1, wherein the stamping mark includes at least two stamping marks, a first one of the at least two stamping marks being located adjacent to the slit opening and a second one of the at least two stamping marks being located adjacent to the slit opening and opposite the first one of the at least two stamping marks.

3. The connection carrier according to claim 1, wherein:

the second end includes a first portion forming an upper surface and a second portion forming a lower surface, the upper and lower surfaces defining the recess opening; and wherein the stamping mark includes at least two stamping marks, one of the at least two stamping marks being provided in the upper surface and another of the at least two stamping marks being provided in the lower surface.

4. A connection carrier, comprising:

a conductive member having a first side and a second side; and wherein the second side has a recess opening for receiving a wire end, the recess opening including a recess end region, a stamping mark formed on the conductive member adjacent to the recess opening forming a slit opening which progresses to a V-shaped opening towards the second side, the slit opening providing a predetermined reduction of an opening width of the recess end region.

5. A method for producing a connection carrier, comprising the steps of:

punching a recess opening in a conductive member, the recess opening including a recess end region having an opening width;

stamping the recess end region to reduce the opening width of the recess end region;

introducing at least one region of a wire end into the recess end region; and at least partially deforming the conductive member to rigidly connect the at least one region of the wire end to the conductive member.

6. The method according to claim 5, wherein:

the conductive member includes a first portion and a second portion, the first and second portions defining the recess opening; and the stamping step is performed using a stamping tool having at least one stamping punch which applies a force against at least one of the first portion and the second portion.

7. The method according to claim 6, wherein:

the first portion includes an upper surface and the second portion includes a lower surface, the upper and lower surfaces being adjacent to the recess end region; and wherein the stamping step produces a stamping mark on the upper surface adjacent to the recess end region and on the lower surface adjacent to the recess end region.

8. The method according to claim 6, wherein:

the first portion and the second portion can be forcibly moved towards each other in a first direction; and the force applied by the stamping tool against at least one of the first portion and the second portion is applied in a direction perpendicular to the first direction.

9. The method according to claim 8, wherein the deforming step further includes the step of resistance heating the first portion and the second portion.

10. The method according to claim 6, wherein the at least one stamping punch has a rectangular punch face.

11. The method according to claim 6, wherein the at least one stamping punch has an ellipsoidal punch face.

12. The method according to claim 6, wherein the at least one stamping punch has a circular punch face.

13. The method according to claim 6, wherein the at least one stamping punch has a gridded punch face.

* * * * *

UNITED STATES PATENT AND TRADEMARK OFFICE

CERTIFICATE OF CORRECTION

PATENT No. : 5,561,270

DATED : Oct. 1, 1996

INVENTOR(S): Baessler et al.

It is certified that error appears in the above-identified patent and that said Letters Patent is hereby corrected as shown below:

Column 1, line 33, change "15" to --1 5--;

Column 4, line 57, insert --19-- after region;

Signed and Sealed this

Twentieth Day of May, 1997

*Attest:*

*Attesting Officer*

Bruce Lehman

BRUCE LEHMAN

*Commissioner of Patents and Trademarks*